US010944201B2

(12) United States Patent
Iwabe et al.

(10) Patent No.: US 10,944,201 B2
(45) Date of Patent: Mar. 9, 2021

(54) CONNECTOR HAVING WATERPROOF STRUCTURE CAPABLE OF PREVENTING UNINTENTIONAL DETACHMENT OF A PACKING

(71) Applicant: Yazaki Corporation, Tokyo (JP)

(72) Inventors: Masaaki Iwabe, Shizuoka (JP); Yuya Yamada, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 30 days.

(21) Appl. No.: 16/223,939

(22) Filed: Dec. 18, 2018

(65) Prior Publication Data

US 2019/0190188 A1 Jun. 20, 2019

(30) Foreign Application Priority Data

Dec. 20, 2017 (JP) ..... JP2017-243573

(51) Int. Cl.
*H01R 13/40* (2006.01)
*H01R 13/52* (2006.01)
*H01R 13/502* (2006.01)

(52) U.S. Cl.
CPC ..... *H01R 13/5202* (2013.01); *H01R 13/5025* (2013.01); *H01R 13/5213* (2013.01)

(58) Field of Classification Search
CPC ..... H01R 13/5202; H01R 13/5025; H01R 13/6215; H01R 13/52; H01R 13/5213
USPC ..... 439/589, 271, 586
See application file for complete search history.

(56) References Cited

U.S. PATENT DOCUMENTS

2011/0300731 A1* 12/2011 Nakamura ..... H01R 13/504 439/271
2012/0115356 A1 5/2012 Tashiro
2013/0316579 A1* 11/2013 Nakayama ..... H01R 13/506 439/607.01
2014/0377978 A1* 12/2014 Okamoto ..... H01R 13/5202 439/345
2015/0180159 A1* 6/2015 Endo ..... H01R 13/60 439/587
2016/0043500 A1* 2/2016 Mori ..... H01R 13/504 439/271
2018/0269624 A1* 9/2018 Iwabe ..... H01R 13/6215
2019/0109408 A1* 4/2019 Maddens ..... H01R 13/5219

FOREIGN PATENT DOCUMENTS

JP 2006-48998 A 2/2006
JP 2011-054394 A 3/2011
JP 2012-252858 A 12/2012

* cited by examiner

*Primary Examiner* — Hae Moon Hyeon
(74) *Attorney, Agent, or Firm* — Sughrue Mion, PLLC

(57) ABSTRACT

A waterproof structure for a connector includes a housing retaining terminals and having an opening, a cover closing the opening, and a packing mounted on the cover and sealing between the housing and the cover at the opening. The cover has through holes and projections projecting from an outer surface of the cover. The packing has a body sandwiched between the housing and the cover and locked portions continuous to the body. The locked portion projects from the through hole to an exterior space of the cover toward a direction in which the projection projects, and the locked portion is locked by the projection at least in a direction perpendicular to the direction of projection of the projection.

6 Claims, 16 Drawing Sheets

CONNECTOR HAVING WATERPROOF STRUCTURE CAPABLE OF PREVENTING UNINTENTIONAL DETACHMENT OF A PACKING

CROSS-REFERENCE TO RELATED APPLICATION(S)

The present application claims priority to and incorporates by reference the entire contents of Japanese Patent Application No. 2017-243573 filed in Japan on Dec. 20, 2017.

BACKGROUND OF THE INVENTION

1. Field of the Invention

The present invention relates to a waterproof structure for a connector.

2. Description of the Related Art

Known techniques are used to mount a packing to a connector. Japanese Patent Publication Laid-open No. 2011-54394 describes a technique for a connector that includes: an annular body part, at least a pair of ear parts extending outward from the body part, a packing including locked portions provided to the ear parts, an annular packing-mounted part that is provided on the periphery of an opening of a body part having the opening and has the packing body part mounted thereon, a flange part integrally formed with the body part in a manner surrounding the packing-mounted part of the body part, and a case that has at least a pair of through holes that are formed on the body part in a manner connecting the packing-mounted part and a back face of the flange part with each other and has at least a pair of locking parts that are provided to the back face of the flange part and lock respective locked portions of the ear parts.

Unintentional detachment of a packing from a locking part decreases waterproof performance of the connector. A technique to prevent such unintentional detachment is therefore awaited. For example, in Japanese Patent Application Laid-open No. 2011-54394, the locking parts are projections, and the locked portions are through holes on the ear parts. If a force toward a direction of a front end of the projection is applied to the ear part, the projection may slip out of the through hole, and the packing may be unintentionally detached from the packing.

SUMMARY OF THE INVENTION

An object of the present invention is to provide a waterproof structure for a connector capable of preventing unintentional detachment of a packing.

In order to solve the above mentioned problem and achieve the object, a waterproof structure for a connector according to one aspect of the present invention includes a housing that retains a terminal and has an opening; a cover that closes the opening; and a packing that is mounted on the cover and seals between the housing and the cover at the opening, wherein the cover has a through hole and a projection projecting from an outer surface of the cover, the packing has a body sandwiched between the housing and the cover and a locked portion continuous to the body, and the locked portion projects to an exterior space of the cover from the through hole toward a direction in which the projection projects, and the locked portion is locked by the projection at least in a direction perpendicular to the direction in which the projection projects.

According to another aspect of the present invention, in the waterproof structure for a connector, it is preferable that the projection projects from an outer surface of the cover toward a side opposite to a side of the housing, the locked portion is capable of receiving the projection, and the projection locks the locked portion by being arranged in the locked portion.

According to still another aspect of the present invention, in the waterproof structure for a connector, it is preferable that the locked portion is further locked by a front end of the projection in the direction in which the projection projects.

According to still another aspect of the present invention, in the waterproof structure for a connector, it is preferable that the projection projects from an edge of the through hole and has an arcuate cross section that is open toward a side of the through hole, the packing has a shaft portion connecting between the body and the locked portion, and the locked portion has a recessed portion that receives a front end portion of the projection, and the locked portion is locked by the projection arranged in the recessed portion.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

A waterproof structure for a connector according to embodiments of the present invention will now be described in detail with reference to the drawings. It should be noted that the embodiments are not intended to limit the present invention. Components described in the embodiments include what the skilled person could easily conceive of and what are substantially the same.

First Embodiment

Figure 1:
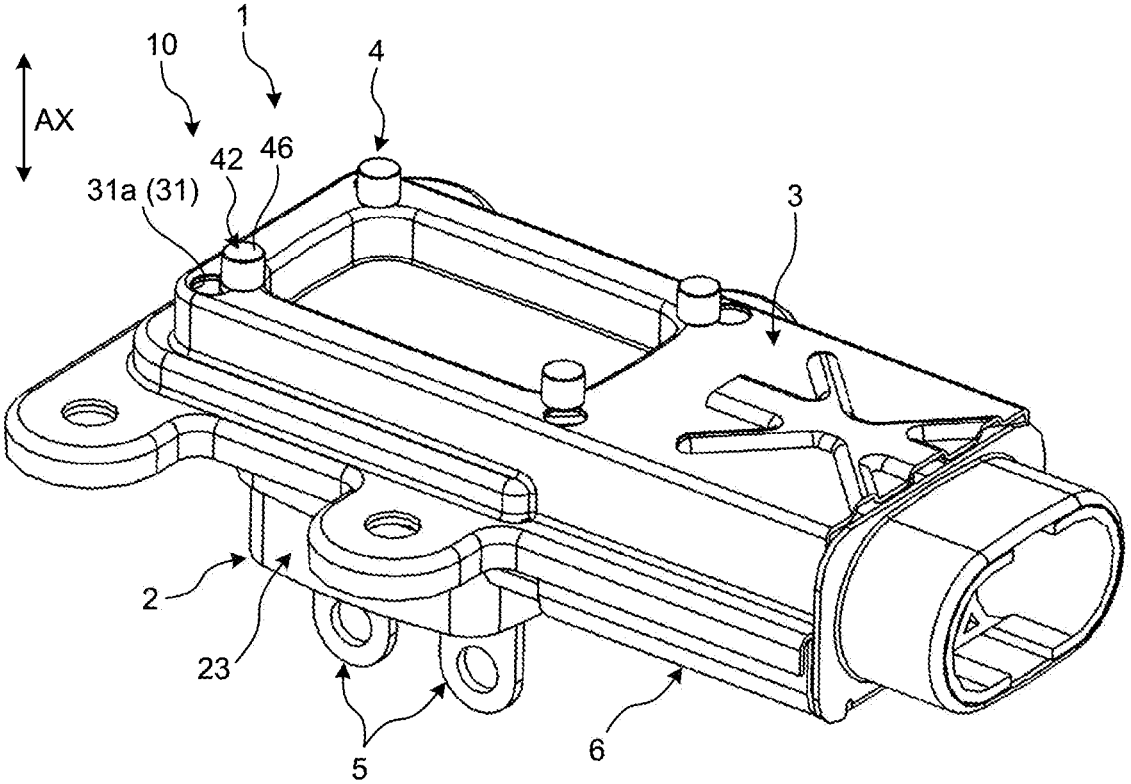
FIG. 1 is a perspective view of a connector according to a first embodiment.
Figure 2:
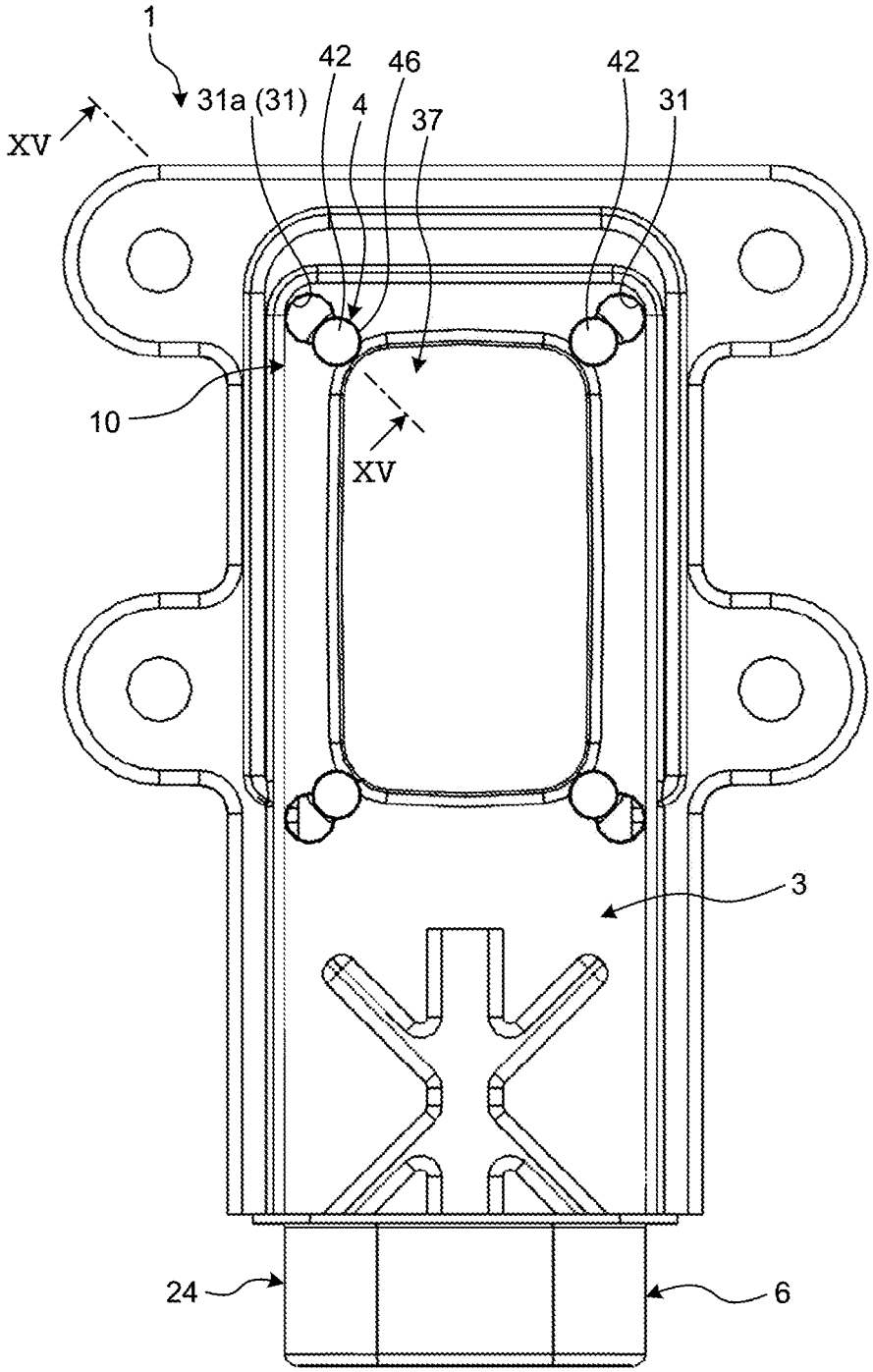
FIG. 2 is a plan view of the connector according to the first embodiment.
Figure 3:
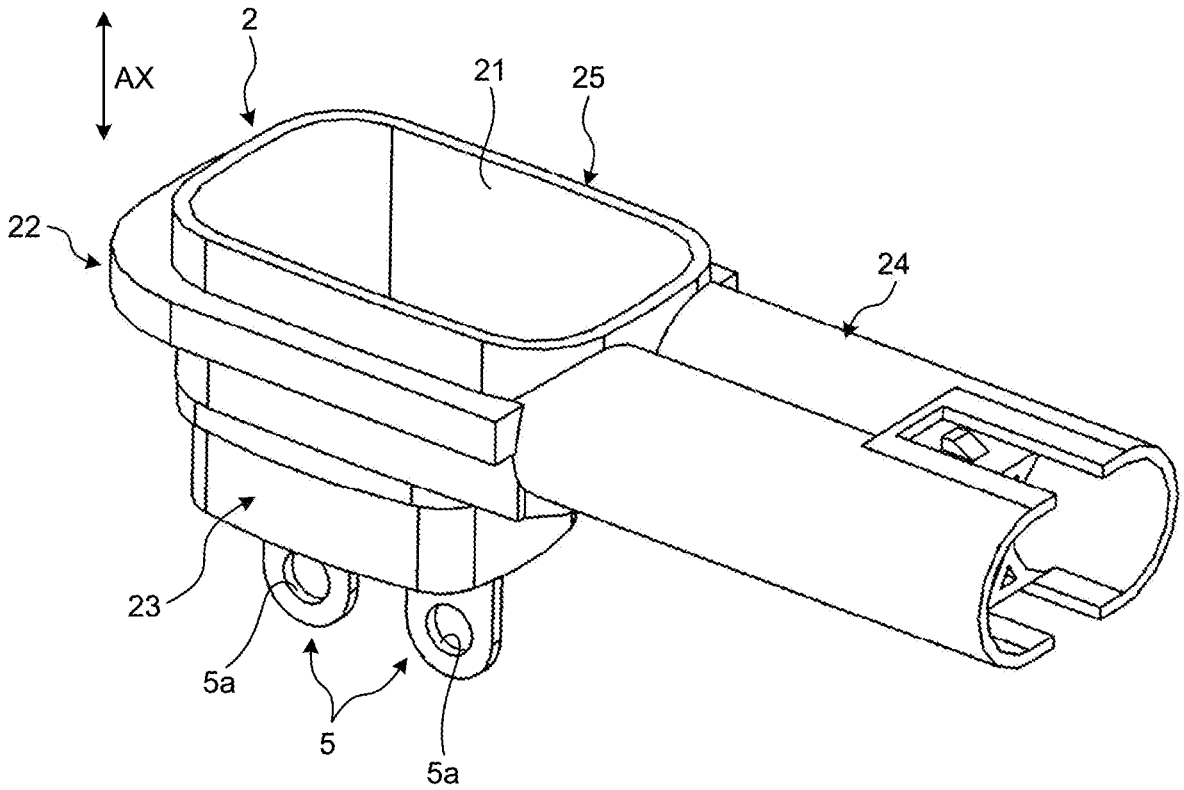
FIG. 3 is a perspective view of a housing according to the first embodiment.
Figure 4:
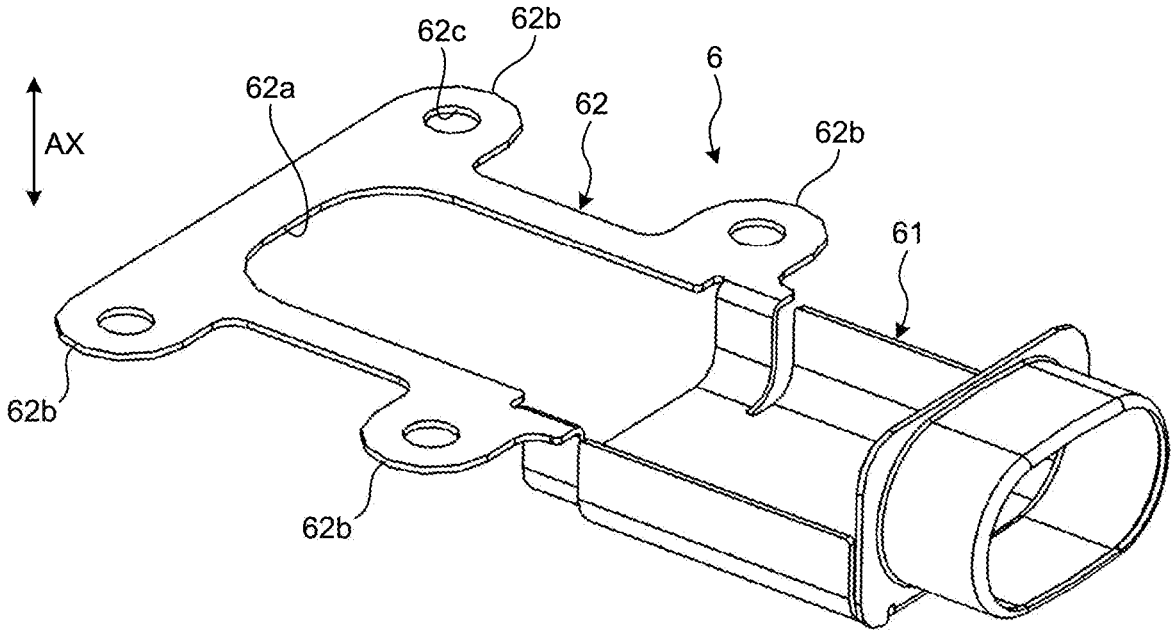
FIG. 4 is a perspective view of a shield shell according to the first embodiment.
Figure 5:
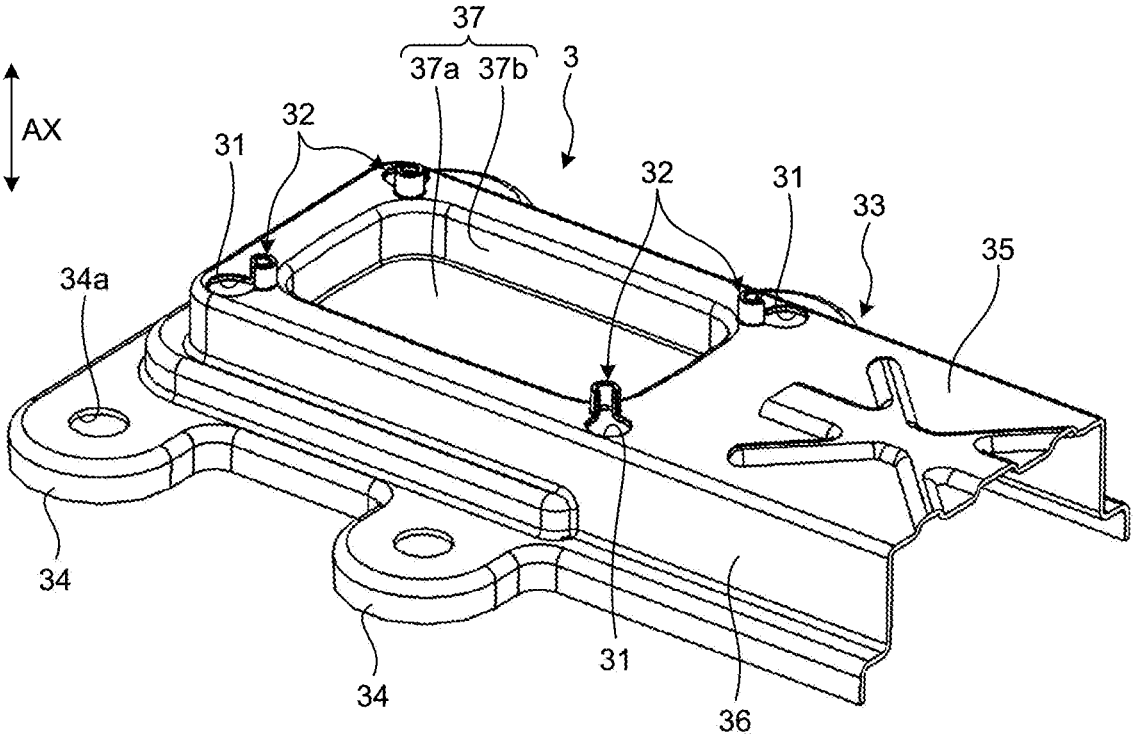
FIG. 5 is a perspective view of a cover according to the first embodiment.
Figure 8:
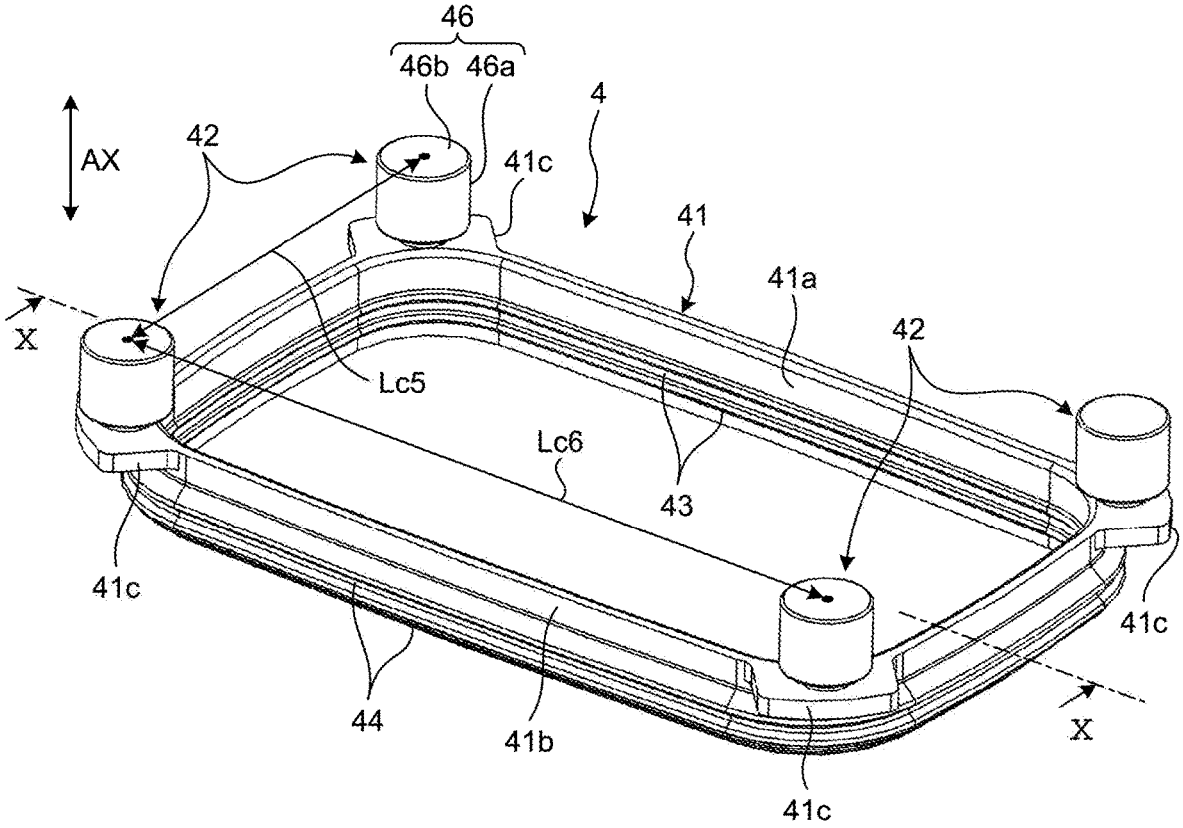
FIG. 8 is a perspective view of a packing according to the first embodiment.
Figure 9:
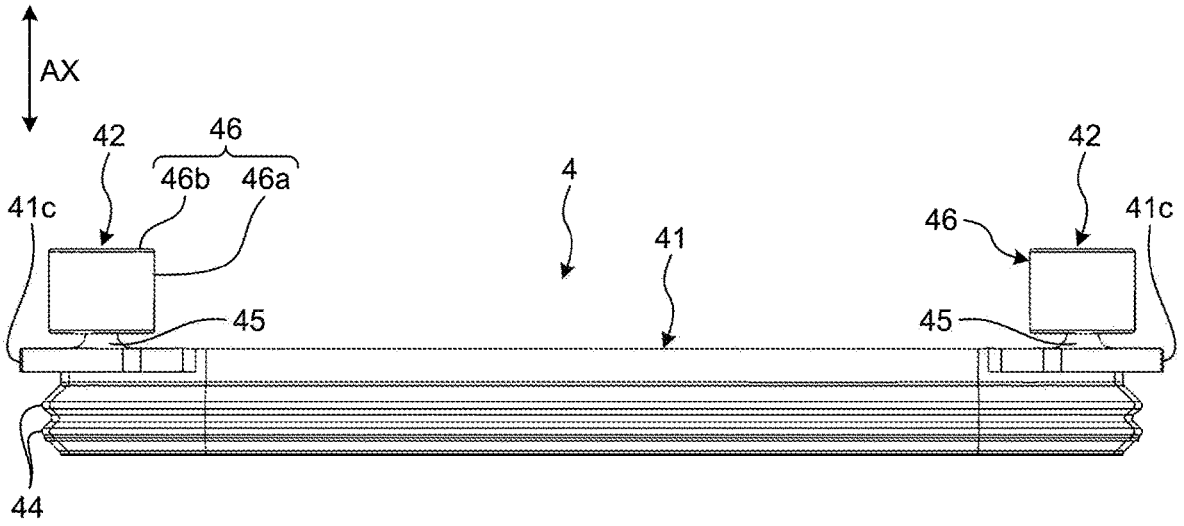
FIG. 9 is a side view of the packing according to the first embodiment.
Figure 10:
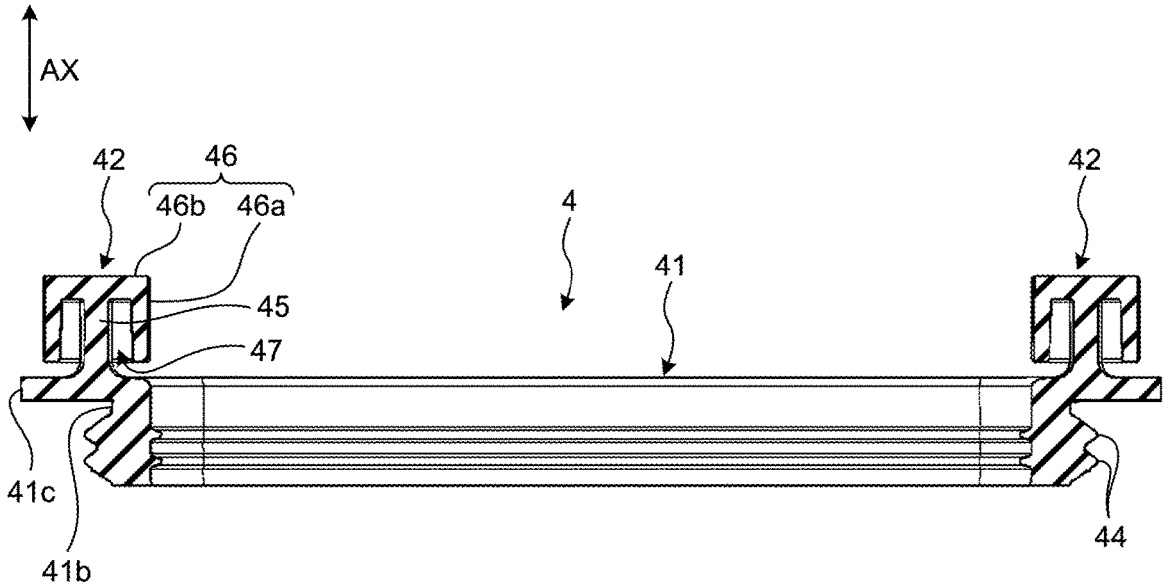
FIG. 10 is a sectional view of the packing according to the first embodiment.
Figure 11:
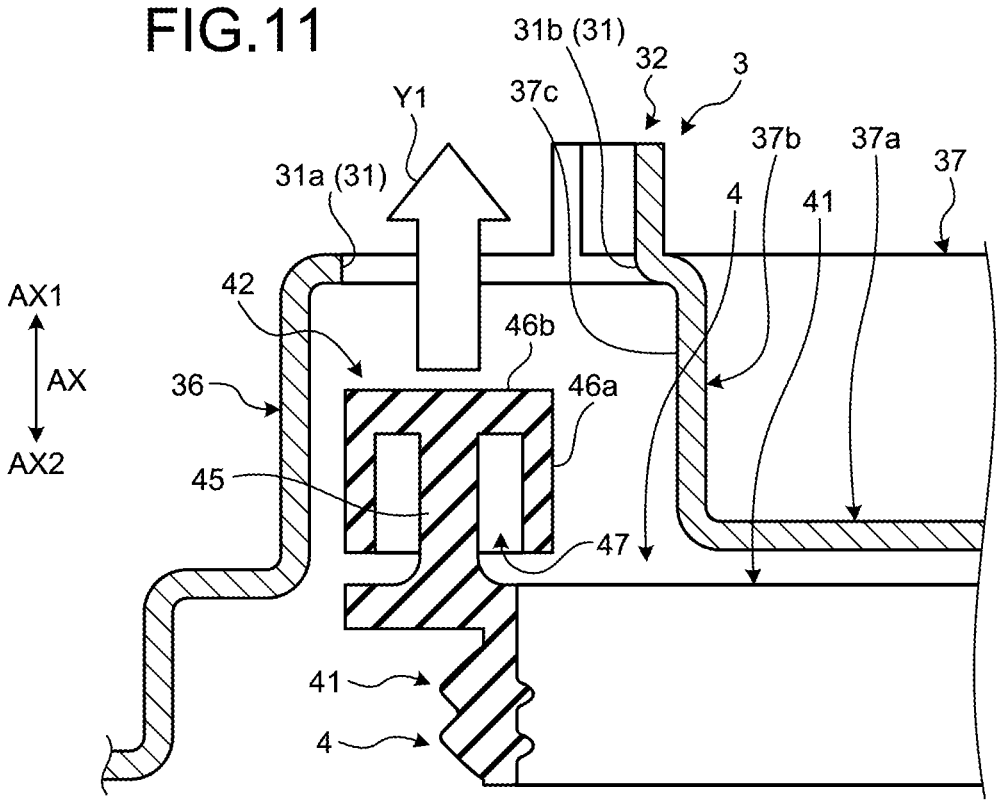
FIG. 11 is a sectional view illustrating a procedure of mounting the packing of the first embodiment.
Figure 12:
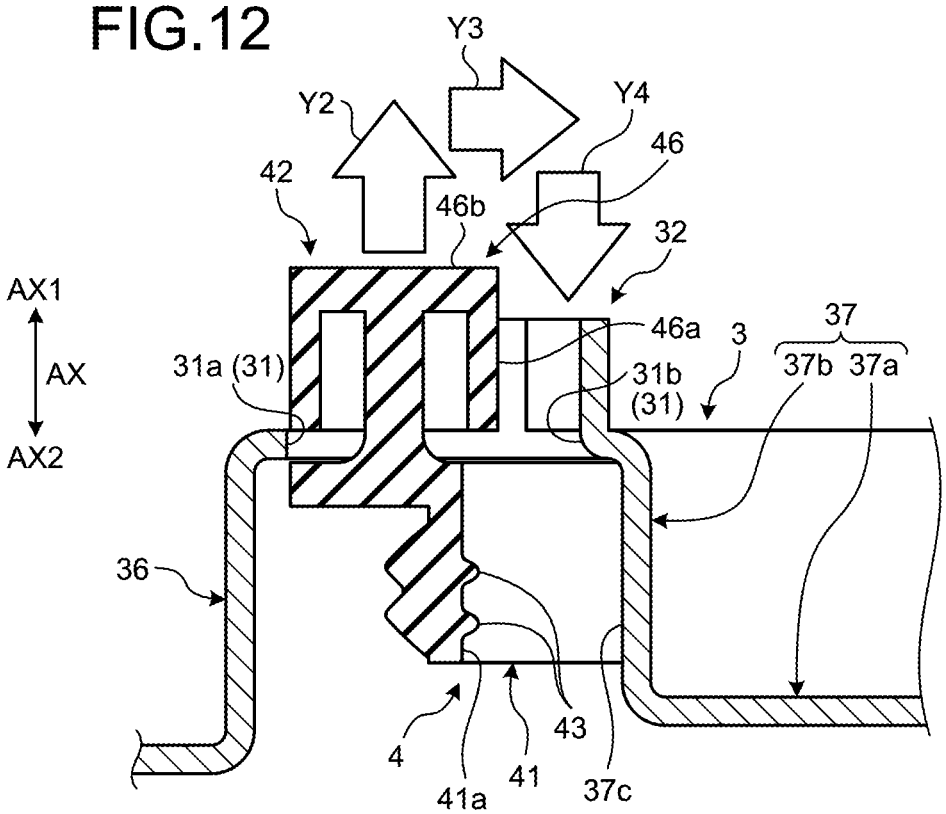
FIG. 12 is another sectional view illustrating the procedure of mounting the packing of the first embodiment.
Figure 13:
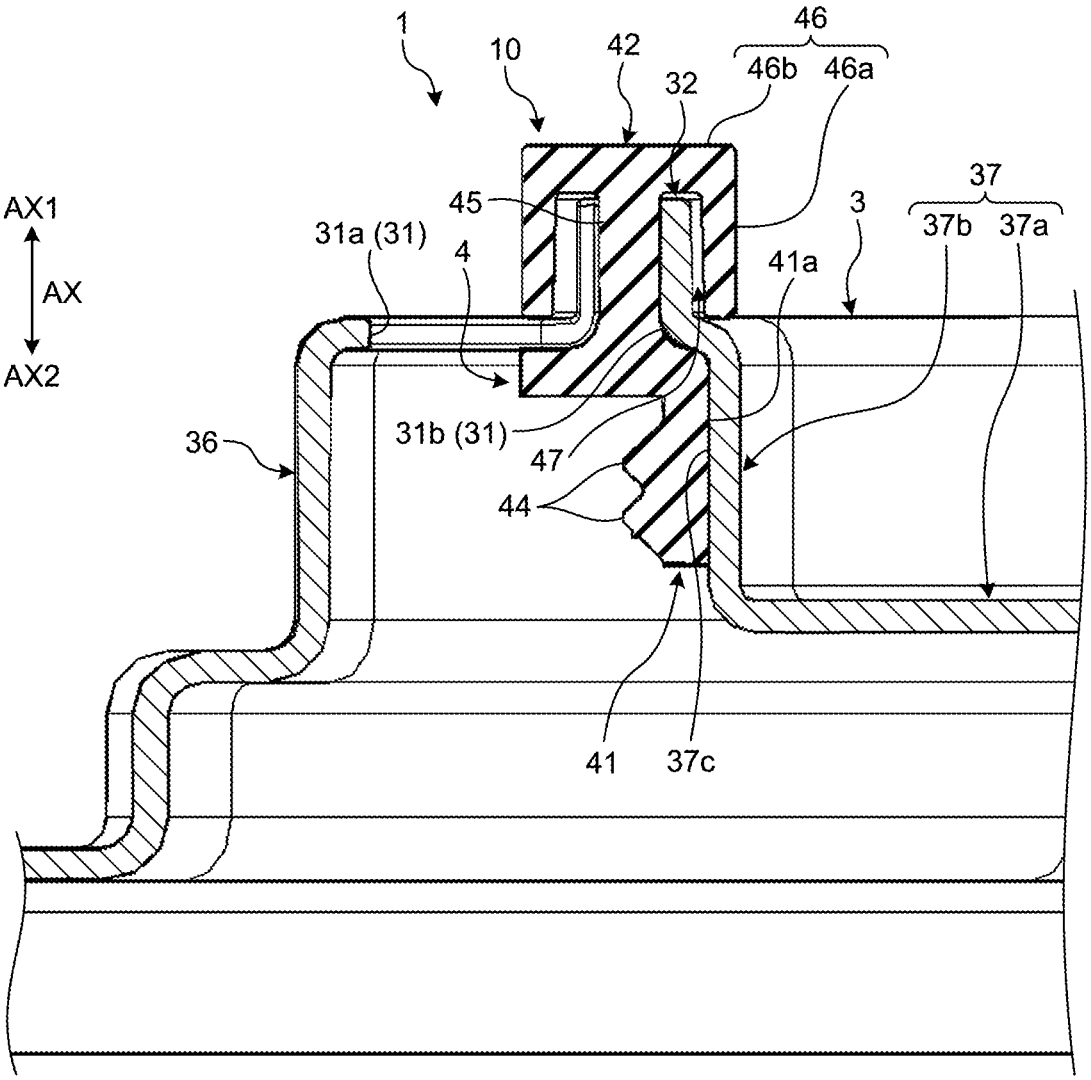
FIG. 13 is a sectional view of an essential part of the cover with the packing mounted.
Figure 14:
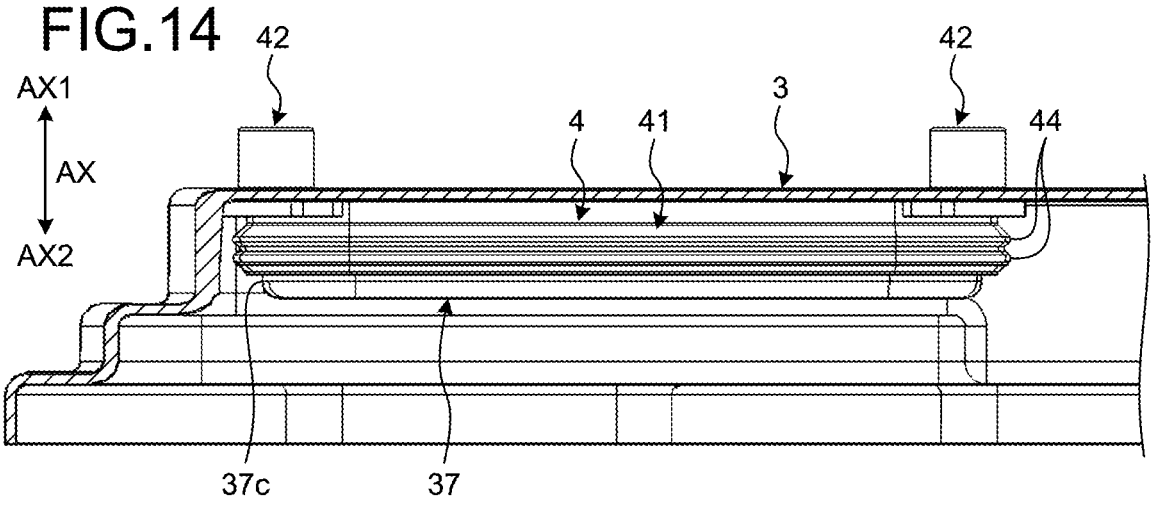
FIG. 14 is another sectional view of the cover with the packing mounted.
Figure 15:
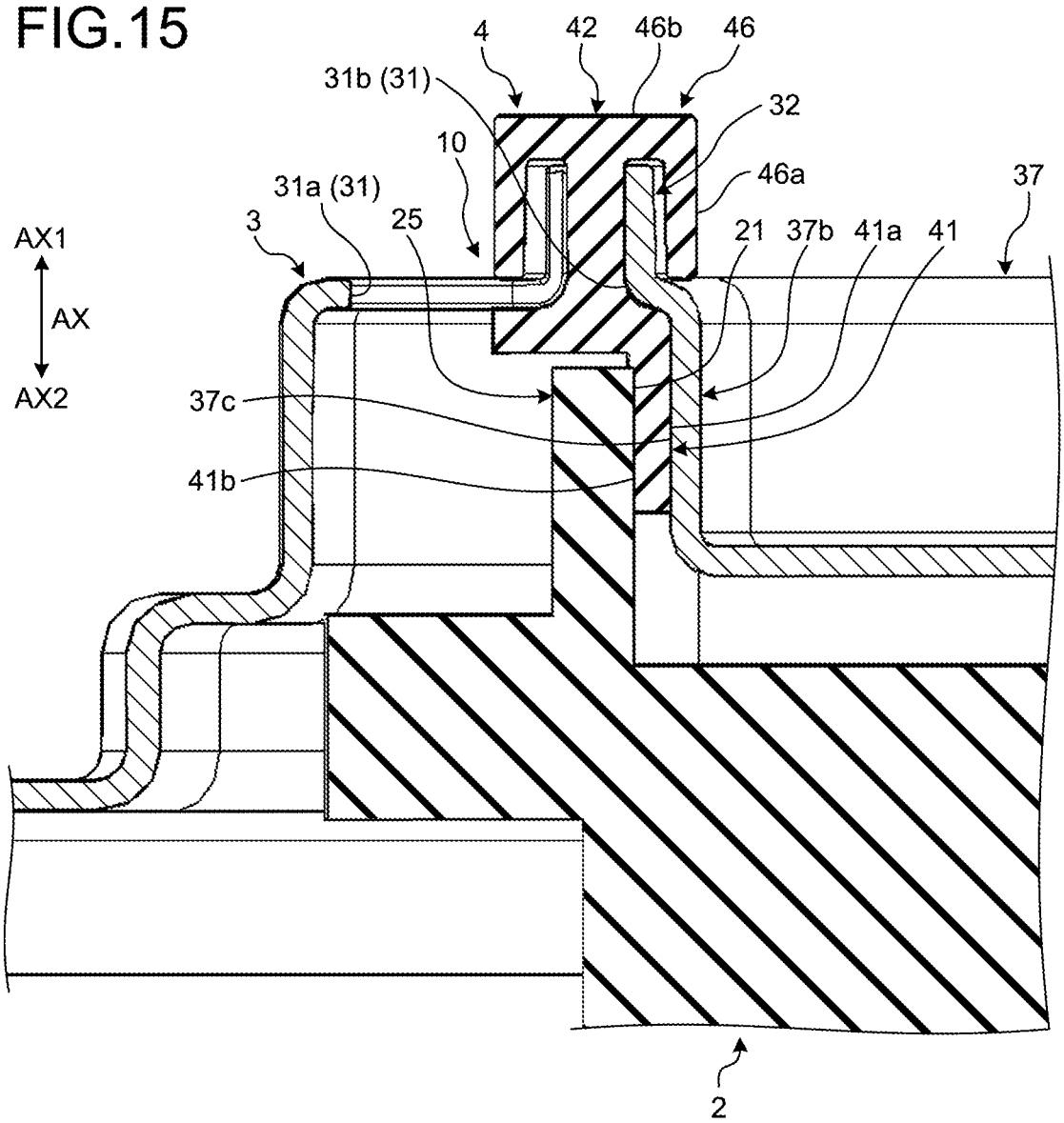
FIG. 15 is a sectional view illustrating a waterproof structure for a connector according to the first embodiment.

A first embodiment will now be described with reference to FIGS. 1 to 15. This embodiment relates to a waterproof structure for a connector. FIG. 1 is a perspective view of a connector according to the first embodiment. FIG. 2 is a plan view of the connector according to the first embodiment. FIG. 3 is a perspective view of a housing according to the first embodiment. FIG. 4 is a perspective view of a shield shell according to the first embodiment. FIG. 5 is a perspective view of a cover according to the first embodiment. FIG. 8 is a perspective view of a packing according to the first embodiment. FIG. 9 is a side view of the packing according to the first embodiment. FIG. 10 is a sectional view of the packing according to the first embodiment. FIG. 11 is a sectional view illustrating a procedure of mounting the packing of the first embodiment. FIG. 12 is another sectional view illustrating the procedure of mounting the packing of the first embodiment. FIG. 13 is a sectional view of an essential part of the cover with the packing mounted. FIG. 14 is another sectional view of the cover with the packing mounted. FIG. 15 is a sectional view illustrating a waterproof structure for a connector according to the first embodiment.

FIG. 10 is a sectional view of FIG. 8 along X-X line. FIG. 15 is a sectional view of FIG. 2 along XV-XV line. The sectional positions of FIGS. 11 to 13 are the same as that of the FIG. 15.

As illustrated in FIGS. 1 and 2, a connector 1 according to this embodiment includes a housing 2, a cover 3, a packing 4, terminals 5, and a shield shell 6. The connector 1 of this embodiment is a shield connector and covers the housing 2 with the shield shell 6 and the cover 3 and blocks noise.

The housing 2 is a member for retaining the terminals 5. The housing 2 is formed of, for example, insulating synthetic resin. As illustrated in FIG. 3, the housing 2 has a body 22, a mating portion 23, and a connecting portion 24. The body 22, the mating portion 23, and the connecting portion 24 are integrally formed. The body 22 is a tubular constituent. The body 22 of this embodiment has a substantially rectangular cross section. A direction along a center axis of the body 22 will be referred to as an "axial direction AX".

The mating portion 23 is disposed at an end of the body 22 in the axial direction AX. The mating portion 23 is a tubular constituent. The mating portion 23 of this embodiment has a substantially rectangular cross section. The mating portion 23 mates with a mated portion provided to a connected device. Examples of the connected device include an inverter mounted on a vehicle.

A part of the terminal 5 projects from a front end of the mating portion 23. The terminal 5 is physically and electrically connected with a terminal unit provided to the connected device. Each projecting portion of the terminal 5 has a hole 5*a*. For example, the hole 5*a* receives a screw fastened to the terminal unit of the connected device.

The connecting portion 24 projects from a side surface of the body 22 toward a direction perpendicular to the axial direction AX. The connecting portion 24 is connected with, for example, another connector to be connected. The connecting portion 24 is tubular and includes therein a conductive member such as an electric wire and a bus bar. The conductive member has an end connected to the terminal 5 inside the housing 2 and the other end connected to another connector to be connected through a terminal unit provided to the front end of the connecting portion 24.

The body 22 has an opening 21. More specifically, the body 22 has a tubular portion 25 projecting toward a side opposite to the mating portion 23. The tubular portion 25 has a substantially rectangular cross section. The opening 21 forms an open end of the tubular portion 25. The opening 21 is what is called a servicing hole. The interior space and the exterior space of the housing 2 communicate with each other through the opening 21. A worker can reach the terminal 5 through the opening 21. The worker inserts a tool or the like from the opening 21 and, for example, connects the terminals 5 with a connected device.

As illustrated in FIG. 4, the shield shell 6 has a retaining portion 61 and a plate portion 62. The shield shell 6 is formed of a conductive material, for example, formed of a conductive metal such as copper and aluminum. The retaining portion 61 retains the connecting portion 24 of the housing 2 and covers the connecting portion 24. The plate portion 62 is continuous to an end of the retaining portion 61. The plate portion 62 is a flat plate-like constituent and has a hole 62*a* fitting to the shape of the body 22 of the housing 2. The hole 62*a* receives the body 22. The plate portion 62 has a plurality of fixed portions 62*b*. The fixed portion 62*b* projects outward in the width direction of the plate portion 62. Each fixed portion 62*b* has a screw hole 62*c*.

As illustrated in FIG. 1, the cover 3 covers the housing 2 from a side opposite to the mating portion 23. The cover 3 is formed of a conductive material, for example, formed of a conductive metal such as copper and aluminum. As illustrated in FIG. 5, the cover 3 has a cover body 33 and fixed portions 34. The cover body 33 has a main wall portion 35, a side wall portion 36, and a mating portion 37. The main wall portion 35 is a wall portion facing the housing 2 in the axial direction AX. More specifically, the main wall portion 35 faces the housing 2 on the side opposite to the mating portion 23. The main wall portion 35 covers the body 22 of the housing 2 from a side of the axial direction AX. In plan view, the main wall portion 35 is rectangular.

The side wall portion 36 is a wall portion intersecting with the main wall portion 35. The side wall portion 36 is arranged upright on three sides of the main wall portion 35. The side wall portion 36 covers the body 22 and the connecting portion 24 of the housing 2 from lateral sides. The mating portion 37 projects from the main wall portion 35 toward the same direction as the direction in which the side wall portion 36 projects. The mating portion 37 mates with the tubular portion 25 of the housing 2. The mating portion 37 has a bottom wall portion 37*a* and a peripheral wall portion 37*b*. The peripheral wall portion 37*b* is arranged upright toward the axial direction AX with respect to the main wall portion 35. The peripheral wall portion 37*b* of this embodiment is perpendicular to the main wall portion 35. The peripheral wall portion 37*b* of this embodiment has a substantially rectangular cross section. More specifically, the peripheral wall portion 37*b* has a rectangular cross section with the four corners curved. The peripheral wall portion 37*b* is formed with a clearance from the side wall portion 36. The bottom wall portion 37*a* closes a front end of the peripheral wall portion 37*b* in a direction in which the peripheral wall portion 37*b* projects. The bottom wall portion 37*a* is, for example, perpendicular to the axial direction AX.

The fixed portion 34 projects from the side wall portion 36 toward a direction perpendicular to the axial direction AX. The cover 3 has a plurality of fixed portions 34. Each fixed portion 34 is formed at a location corresponding to the fixed portion 62*b* of the shield shell 6. The fixed portion 34 has a screw hole 34*a*. The fixed portion 34 and the fixed portion 62*b* are stacked on one over the other and are fastened to a connected device by a screw.

The cover 3 has a plurality of through holes 31 and a plurality of projections 32. The through holes 31 and the projections 32 are formed on the main wall portion 35. Four pairs of through holes 31 and projections 32 are formed at respective four corners of the mating portion 37. In other words, a pair of through hole 31 and projection 32 is arranged at a corner of the mating portion 37.

The through hole 31 penetrates the main wall portion 35. The projection 32 projects from an outer surface of the main wall portion 35. In description of the cover 3, the "outer surface" indicates a surface exposed to the exterior space, whereas an "inner surface" indicates a surface facing the housing 2 and the shield shell 6. The projection 32 projects toward a side opposite to the housing 2 side with the cover 3 assembled to the housing 2. The projection 32 is formed at a location closer to the mating portion 37 with respect to the through hole 31. The through hole 31 fits to the shape of a locked portion 46 (see FIG. 8) of the packing 4. More specifically, the through hole 31 is in a shape and a size capable of receiving the locked portion 46.

Figure 6:
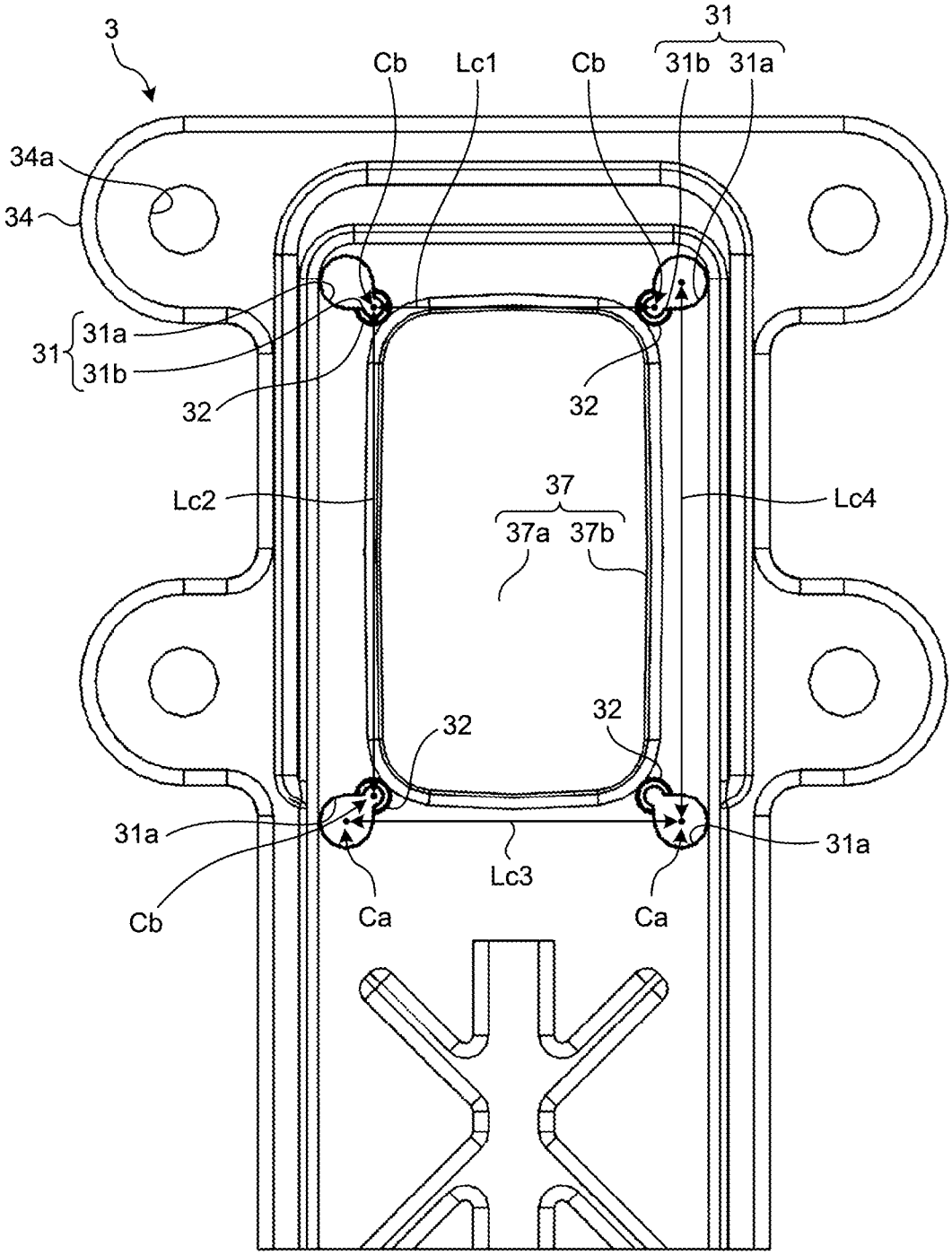
FIG. 6 is a plan view of the cover according to the first embodiment.
Figure 7:
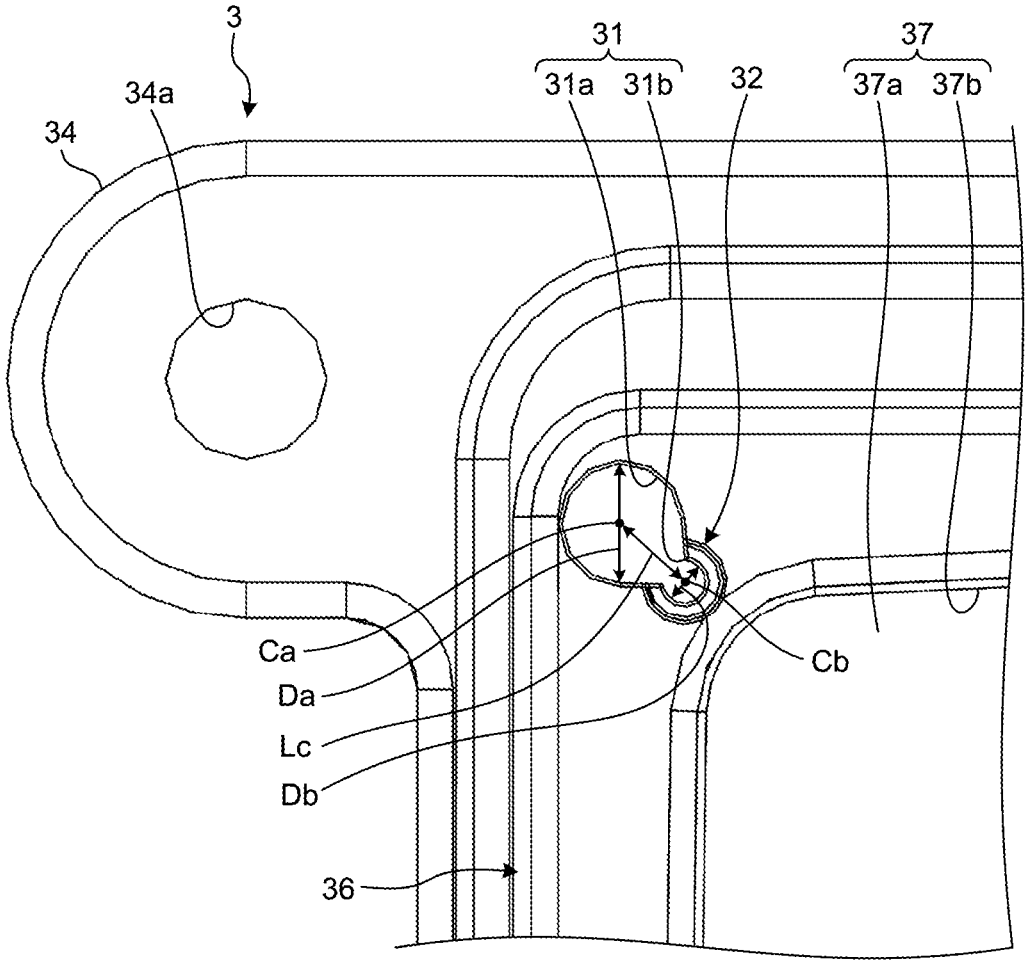
FIG. 7 is an enlarged plan view of a part of the cover according to the first embodiment.

As illustrated in FIG. 6 and FIG. 7, the through hole 31 of this embodiment has a shape in which two circles link to each other. More specifically, the through hole 31 is formed such that a first circle and a second circle that is slightly smaller than the first circle are combined to form a shape of "8" in Arabic number. As illustrated in FIG. 7, the through hole 31 has a large diameter portion 31*a* surrounded by a relatively large circular arc and a small diameter portion 31*b* surrounded by a relatively small circular arc. A diameter Da of the large diameter portion 31*a* is larger than a diameter Db of the small diameter portion 31*b*. The large diameter portion 31*a* and the small diameter portion 31*b* communicate with each other in a manner forming a single through hole. A linear distance Lc from a center Ca of the large diameter portion 31*a* to a center Cb of the small diameter portion 31*b* is larger than the radius of the large diameter portion 31*a*. The following formula (1) is thus given to express the through hole 31. In other words, the center Cb of the small diameter portion 31*b* is positioned outside a hypothetical circle having the diameter Da, the center position of the diameter Da corresponding to the center Ca of the large diameter portion 31*a*.

$$Lc > Da/2 \quad (1)$$

The small diameter portion 31*b* is positioned closer to the mating portion 37 than the large diameter portion 31*a* is. The through hole 31 of this embodiment has the small diameter portion 31*b* positioned between the large diameter portion 31*a* and an edge of the mating portion 37. The small diameter portion 31*b* is surrounded by the later-described projection 32.

The diameter Da of the large diameter portion 31*a* is larger than an outer diameter of the later-described locked portion 46 (see FIG. 10).

The diameter Db of the small diameter portion 31*b* is smaller than the outer diameter of the locked portion 46 and is larger than an outer diameter of a later-described shaft portion 45 (see FIG. 9).

The large diameter portion 31*a* therefore permits the locked portion 46 to pass through the large diameter portion 31*a*. On the other hand, the small diameter portion 31*b* does not permit the locked portion 46 to pass through the small diameter portion 31*b*. The small diameter portion 31*b* permits the shaft portion 45 to enter the small diameter portion 31*b* from the side of the large diameter portion 31*a* and prevents the locked portion 46 from entering the small diameter portion 31*b* from the side of the large diameter portion 31*a*.

The projection 32 of this embodiment is in a semi-tubular shape, which means that the cross section of the projection 32 is in an open shape. More specifically, the projection 32 of this embodiment is in a semi-cylindrical shape. The projection 32 has an arcuate cross section. In other words, the projection 32 is in the shape of a cylinder having a slit notch. This notch is continuous to the through hole 31. The projection 32 is open toward the side of the through hole 31, which means that the projection 32 has an arcuate cross section that is open toward the side of the through hole 31. The projection 32 is arranged at an edge of the through hole 31 in a manner surrounding a part of the through hole 31.

More specifically, the projection 32 is arranged along the edge of the small diameter portion 31*b* of the through hole 31. The projection 32 is arranged from an end to the other end of the small diameter portion 31*b* in a circumferential direction. In other words, each end of the projection 32 in the circumferential direction is located at a position where the edge of the small diameter portion 31*b* and the edge of the large diameter portion 31*a* intersect with each other.

As illustrated in FIG. 6, the distance between centers Cb of the small diameter portions 31*b* in the short-side direction of the mating portion 37 is a distance Lc1 (hereinafter, simply referred to as a "center-to-center distance Lc1") (see FIG. 6).

The distance between centers Cb of the small diameter portions 31*b* in the long-side direction of the mating portion 37 is a distance Lc2 (hereinafter, simply referred to as a "center-to-center distance Lc2"). The distance between centers Ca of the large diameter portions 31*a* in the short-side direction of the mating portion 37 is a distance Lc3 (hereinafter, simply referred to as a "center-to-center distance Lc3"). The distance between centers Ca of the large diameter portions 31*a* in the long-side direction of the mating portion 37 is a distance Lc4 (hereinafter, simply referred to as a "center-to-center distance Lc4").

As illustrated in FIG. 8, the packing 4 includes a body 41 and retaining units 42. The body 41 and the retaining units 42 are integrally formed of an elastic material such as rubber and silicone. The packing 4 is mounted on the cover 3 and seals between the housing 2 and the cover 3 at the opening 21 of the housing 2. In plan view, the body 41 is in a shape fitting to the mating portion 37. The body 41 of this embodiment is a rectangle with four corners curved. The body 41 is mounted on the peripheral wall portion 37*b* of the mating portion 37 in a manner closely contacting the peripheral wall portion 37*b*.

The body 41 is an endless plate-like constituent having an inner sealing surface 41*a* and an outer sealing surface 41*b*. The inner sealing surface 41*a* is an inner surface of the body 41, and the outer sealing surface 41*b* is an outer surface of the body 41, which is a surface opposite to the inner sealing surface 41*a*. The inner sealing surface 41*a* has a plurality of lips 43. The lips 43 are projections formed around the entire circumference of the inner sealing surface 41*a*. The lips 43 closely contact the peripheral wall portion 37*b* of the cover 3 to form a water stop line. The outer sealing surface 41*b* has a plurality of lips 44. The lips 44 are projections formed around the entire circumference of the outer sealing surface 41*b*. The lips 44 closely contact the opening 21 to form a water stop line.

The retaining unit 42 is disposed at each of four corners of the body 41. The retaining unit 42 projects from a side surface of the body 41. More specifically, the side surface of the body 41 has piece portions 41*c* extending outward. The piece portion 41*c* projects from the body 41 toward a side opposite to the side of a sealing surface (the inner sealing surface 41*a*) between the packing 4 and the cover 3. The piece portion 41*c* is formed at each of the four corners of the body 41, and the retaining unit 42 projects from the piece portion 41*c*.

As illustrated in FIG. 9 and FIG. 10, the retaining unit 42 has the shaft portion 45 and the locked portion 46. The shaft portion 45 projects from the piece portion 41*c* toward the axial direction AX. The locked portion 46 is a receiving portion that receives the projection 32 of the cover 3. The locked portion 46 of this embodiment is a covering portion that covers the projection 32 from the front end side. The locked portion 46 has a tubular portion 46*a* and a closing portion 46*b*. The tubular portion 46*a* is a tubular constituent and is cylindrically formed in this embodiment. The closing portion 46*b* closes an end of the tubular portion 46*a*. The closing portion 46*b* is continuous to a front end of the shaft portion 45. For example, the tubular portion 46*a* and the shaft portion 45 are coaxially arranged. A clearance capable of receiving the projection 32 is formed between an inner peripheral surface of the tubular portion 46*a* and an outer peripheral surface of the shaft portion 45. The locked portion 46 and the shaft portion 45 form an umbrella shape as a unit. The shaft portion 45, the tubular portion 46*a*, and the closing portion 46*b* form an annular recessed portion 47 mating with the projection 32.

As illustrated in FIG. 8, the distance between center axis lines of the locked portions 46 in the short-side direction of the body 41 is a distance Lc5 (hereinafter simply referred to as an "axis-to-axis distance Lc5"). The distance between center axis lines of the locked portions 46 in the long-side direction of the body 41 is a distance Lc6 (hereinafter simply referred to as an "axis-to-axis distance Lc6").

A procedure of mounting the packing 4 to the cover 3 will now be described with reference to FIGS. 11 to 13. The packing 4 is mounted on a sealing surface 37*c* of the peripheral wall portion 37*b* of the cover 3. The sealing surface 37*c* is a surface of the peripheral wall portion 37*b* on the interior space side of the cover 3, which is a surface facing the side wall portion 36. The packing 4 is mounted on the cover 3, for example, by a worker. As indicated by an arrow Y1 of FIG. 11, the worker inserts the locked portion 46 into the through hole 31 of the cover 3. The direction of insertion is a direction toward the exterior space from the interior space of the cover 3. The direction in which the locked portion 46 is inserted into the through hole 31 will be referred to as an "insertion direction AX1". A direction opposite to the insertion direction AX1 will be referred to as a "detachment direction AX2". The insertion direction AX1 is the direction in which the projection 32 projects.

The packing 4 of this embodiment is configured to be stretched when the locked portion 46 is inserted into the large diameter portion 31*a* of the through hole 31. More specifically, the axis-to-axis distance Lc5 (FIG. 8) between the locked portions 46 in the short-side direction of the body 41 is adequately smaller than the center-to-center distance Lc3 between centers Ca illustrated in FIG. 6. For insertion of a pair of locked portions 46 aligned in the short-side direction into the respective large diameter portions 31*a*, the body 41 therefore needs to be stretched along the short-side direction of the body 41. Likewise, the axis-to-axis distance Lc6 (FIG. 8) between the locked portions 46 in the long-side direction of the body 41 is adequately smaller than the distance Lc4 between centers Ca illustrated in FIG. 6. For insertion of a pair of locked portions 46 aligned in the long-side direction into the respective large diameter portions 31*a*, the body 41 therefore needs to be stretched along the long-side direction of the body 41. In this manner, for insertion of four locked portions 46 into the respective large diameter portions 31*a*, the body 41 of the packing 4 is stretched in the short-side direction and in the long-side direction.

The worker holds the locked portions 46 and inserts the locked portions 46 into the through holes 31 toward the insertion direction AX1 while stretching the body 41 of the packing 4. In this embodiment, the locked portion 46 is continuous to the piece portion 41*c*. This configuration prevents excessive load from being applied to the body 41 when the locked portion 46 gets tensioned. Thus, waterproof performance is less likely to decrease with the packing 4 mounted on the cover 3.

As illustrated in FIG. 12, the worker disposes the locked portion 46 so that it can project to the exterior space of the cover 3 toward the insertion direction AX1. In other words, the worker disposes the locked portion 46 so that it can project to the exterior space from the through hole 31 toward the direction in which the projection 32 projects. Then, the worker fits the locked portion 46 onto the front end of the projection 32 as indicated by an arrow Y2 to an arrow Y4 of FIG. 12. More specifically, the worker pulls up the locked portion 46 to a level higher than the projection 32 as indicated by the arrow Y2. The inner sealing surface 41*a* of the packing 4 is accordingly moved to a position facing the sealing surface 37*c* of the mating portion 37. The worker then moves the locked portion 46 toward the projection 32 side as indicated by the arrow Y3. This move causes the stretched body 41 to shrink, and the inner sealing surface 41*a* of the packing 4 contacts the sealing surface 37*c* of the cover 3. The worker fits the locked portion 46 of the retaining unit 42 onto the projection 32 from the front end side as indicated by the arrow Y4.

In this manner, the projection 32 is arranged in the locked portion 46 as illustrated in FIG. 13. The shaft portion 45 of the retaining unit 42 enters the small diameter portion 31*b* of the through hole 31 and a cavity of an axial portion of the projection 32 and contacts the projection 32. The inner diameter of the projection 32 is equal to the diameter Db of the small diameter portion 31*b*, which means that the projection 32 has the inner diameter not allowing the locked portion 46 to enter. The outer diameter of the projection 32 is slightly smaller than the inner diameter of the tubular portion 46*a*. The projection 32 mates with the recessed portion 47 of the locked portion 46. The projection 32 surrounds the shaft portion 45 and supports the shaft portion 45. The shaft portion 45 and the locked portion 46 sandwiches the projection 32.

The projection 32 arranged in the locked portion 46 locks the retaining unit 42 and restricts move of the retaining unit 42. The projection 32 of this embodiment restricts move of the retaining unit 42 in the detachment direction AX2. When the retaining unit 42 starts moving in the detachment direction AX2, the front end of the projection 32 locks the closing portion 46*b* and restricts move of the retaining unit 42. The projection 32 further restricts move of the retaining unit 42 in a direction perpendicular to the axial direction AX. In other words, the projection 32 locks the locked portion 46 in a direction perpendicular to the direction of projection of the projection 32. When the retaining unit 42 starts moving in the direction perpendicular to the axial direction AX, the projection 32 locks the tubular portion 46*a* and the shaft portion 45 and restricts move of the retaining unit 42. In this manner, a waterproof structure 10 for a connector of this embodiment can appropriately prevent displacement of the packing 4 to the cover 3 and unintentional detachment of the packing 4.

The locked portion 46 of this embodiment projects from the through hole 31 toward the direction of projection of the projection 32. In other words, the packing 4 has the body 41 located at the interior space side of the cover 3 with respect to the through hole 31 and has the locked portion 46 located at the exterior space side of the cover 3 with respect to the through hole 31, in the direction of projection of the projection 32. In this state, the locked portion 46 is locked by the projection 32 in the direction perpendicular to the direction of projection of the projection 32. This structure restricts move of the locked portion 46 toward the insertion direction AX1 even when a force toward the insertion direction AX1 is applied to the locked portion 46. This structure therefore prevents easy detachment of the locked portion 46 from the projection 32.

The locked portion 46 moving toward the insertion direction AX1 and slipping out of the projection 32 does not allow the locked portion 46 to be detached from the projection 32. In order for the locked portion 46 to be detached from the projection 32, the locked portion 46 needs to be pulled toward the large diameter portion 31*a* side. More specifically, the axis-to-axis distance Lc5 (FIG. 8) between the locked portions 46 in the short-side direction of the body 41 is equal to the center-to-center distance Lc1 between centers Cb illustrated in FIG. 6 or is slightly smaller than the center-to-center distance Lc1. Furthermore, the axis-to-axis distance Lc6 (FIG. 8) between the locked portions 46 in the long-side direction of the body 41 is equal to the center-to-center distance Lc2 between centers Cb illustrated in FIG. 6 or is slightly smaller than the distance Lc2.

The packing 4 is therefore configured such that the shaft portion 45 contacts the inner peripheral surface of the projection 32 or that the shaft portion 45 is pressed toward the inner peripheral surface of the projection 32. In other words, the packing 4 is configured such that the shaft portion 45 and the locked portion 46 cannot be separated from the projection 32 without pulling the locked portion 46 toward a direction in which the body 41 is stretched. With the waterproof structure 10 for a connector of this embodiment, unintentional detachment of the packing 4 is thus suitably prevented.

FIG. 14 illustrates the cover 3 with the packing 4 mounted. FIG. 14 illustrates the side wall portion 36 cut to illustrate the interior space of the cover 3. The body 41 of the packing 4 closely contacts the mating portion 37 of the cover 3. The body 41 of this embodiment is designed to closely contact the sealing surface 37*c* of the mating portion 37 using elastic resilience.

The cover 3 with the packing 4 mounted is assembled to the housing 2 as illustrated in FIG. 15. The mating portion 37 mates with the inner side of the tubular portion 25 of the housing 2. The body 41 of the packing 4 is sandwiched between the peripheral wall portion 37*b* of the mating portion 37 and the tubular portion 25 and seals between the mating portion 37 and the tubular portion 25. The outer sealing surface 41*b* of the packing 4 closely contacts the opening 21 and forms a water stop line. In this manner, the mating portion 37 and the packing 4 watertightly closes the opening 21 of the housing 2.

As described above, the waterproof structure 10 for a connector of this embodiment includes the housing 2, the cover 3, and the packing 4. The housing 2 retains the terminals 5 and has the opening 21. The cover 3 is a member for closing the opening 21. The packing 4 is mounted on the cover 3 and seals between the housing 2 and the cover 3 at the opening 21.

The cover 3 has the through holes 31 and the projections 32 projecting from an outer surface of the cover 3. The packing 4 has the body 41 sandwiched between the housing 2 and the cover 3 and locked portions 46 continuous to the body 41. The locked portion 46 projects to the exterior space of the cover 3 from the through hole 31 toward the direction of projection of the projection 32 and is locked by the projection 32 at least in a direction perpendicular to the direction of projection of the projection 32. In the waterproof structure 10 for a connector of this embodiment, the locked portion 46 projects to the exterior space of the cover 3 from the through hole 31 and is locked by the projection 32. The projection 32 locks the locked portion 46 in a direction perpendicular to the direction of projection of the projection 32. In this manner, the waterproof structure 10 for a connector of this embodiment can prevent unintentional detachment of the packing 4.

The waterproof structure 10 for a connector of this embodiment can reduce the number of parts. As a comparison, such a structure is conceivable that mounts a waterproof covering member to the housing 2 and covers the waterproof covering member with a shield cover. In this comparative example, a packing is arranged, for example, between the waterproof covering member and the shield cover. The waterproof structure 10 for a connector of this embodiment needs no such waterproof covering members and thus can reduce the number of parts.

The projections 32 of this embodiment project from the outer surface of the cover 3 toward a side opposite to the side of the housing 2. The locked portion 46 is capable of receiving the projection 32. For example, the locked portion 46 may have the recessed portion 47 capable of receiving the projection 32 or may have a ring portion, a hook portion, and others capable of receiving the projection 32. The projection 32 locks the locked portion 46 by being disposed in the locked portion 46. The projection 32 disposed in the locked portion 46 locks the locked portion 46, and this locking suitably prevents unintentional detachment of the packing 4.

The locked portion 46 of this embodiment is further locked by the front end of the projection 32 in the direction of projection of the projection 32. The locked portion 46 in this example has the closing portion 46*b* locked by the front end of the projection 32. The locked portion 46 locked in the direction of projection of the projection 32 can further suitably prevent unintentional detachment of the packing 4.

The projection 32 of this embodiment projects from an edge of the through hole 31 and has an arcuate cross section that is open toward the through hole 31 side. The packing 4 has the shaft portion 45 connecting between the body 41 and the locked portion 46. The locked portion 46 has the recessed portion 47 receiving the front end of the projection 32 and is locked by the projection 32 arranged in the recessed portion 47. This locking mechanism positions the packing 4 with respect to the cover 3 and suitably prevents unintentional detachment of the packing 4.

Second Embodiment

Figure 16:
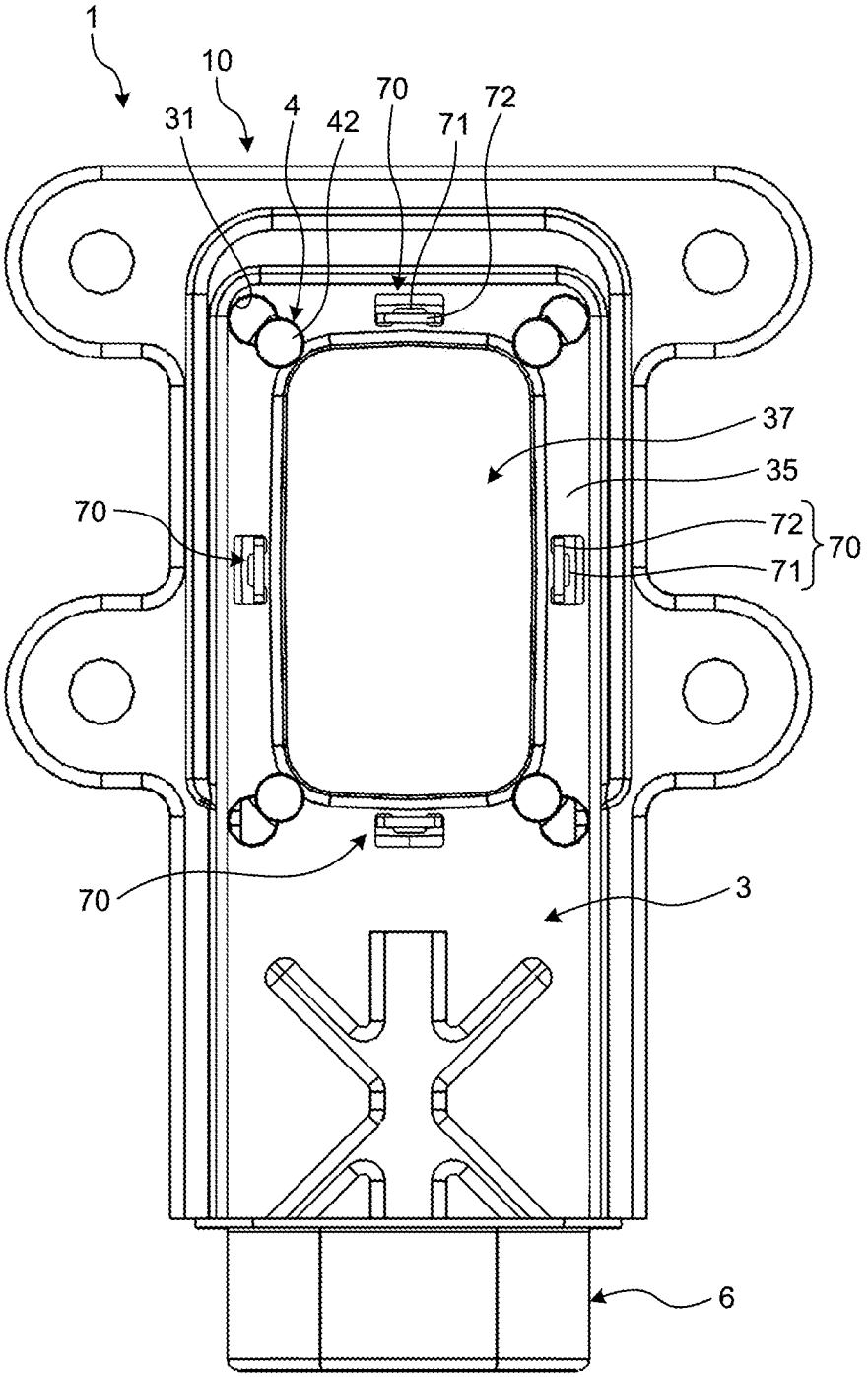
FIG. 16 is a plan view of a connector according to a second embodiment.
Figure 17:
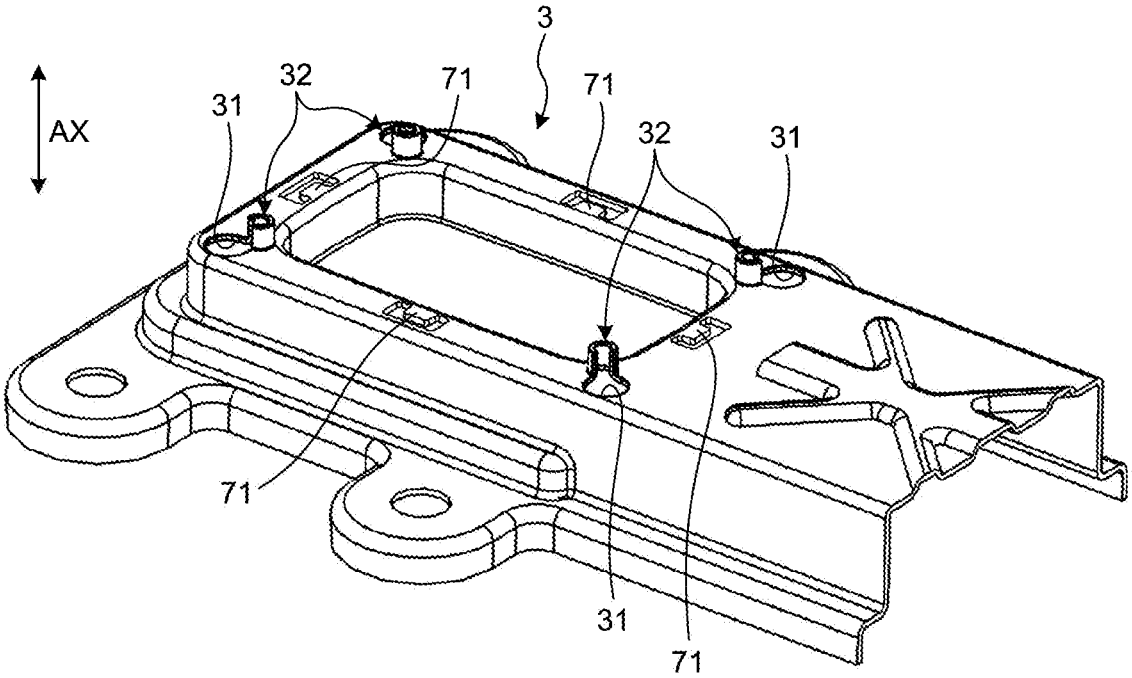
FIG. 17 is a perspective view of the cover according to the second embodiment.
Figure 18:
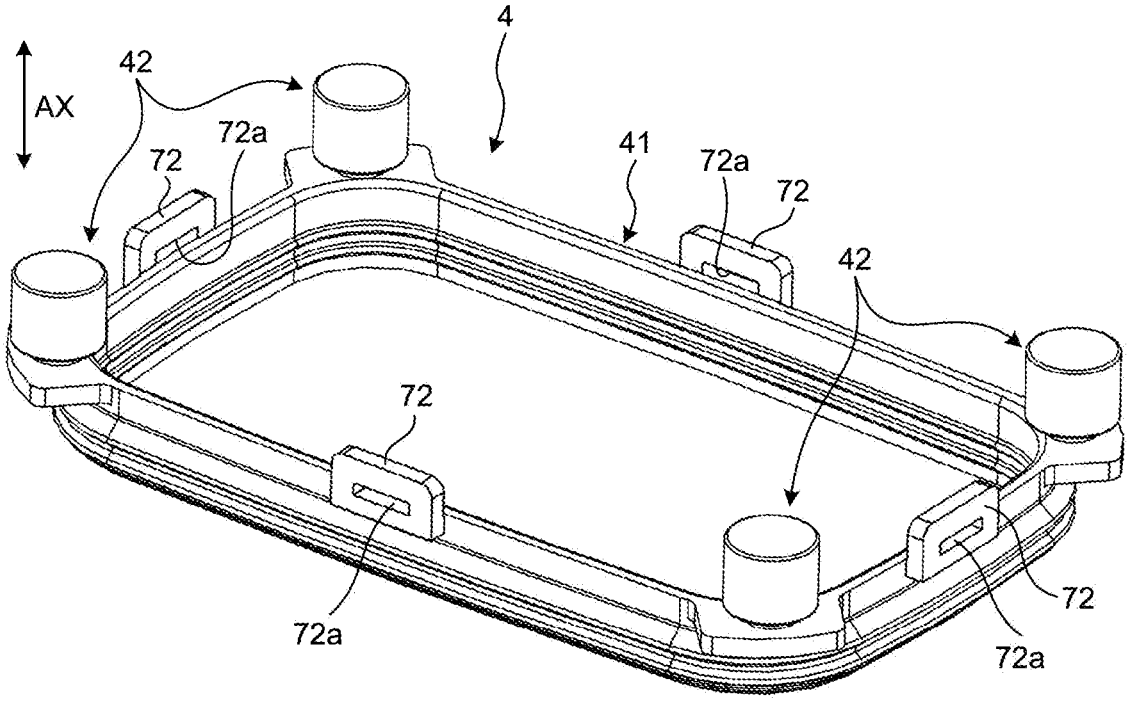
FIG. 18 is a perspective view of a packing according to the second embodiment.

A second embodiment will now be described with reference to FIGS. 16 to 18. In the second embodiment, components having the same functions as those described in the first embodiment will be indicated by the same numerals, and repeated description will be omitted. FIG. 16 is a plan view of a connector according to the second embodiment. FIG. 17 is a perspective view of a cover according to the second embodiment. FIG. 18 is a perspective view of a packing according to the second embodiment. The waterproof structure 10 for a connector according to the second embodiment is different from the waterproof structure 10 for a connector according to the above-described first embodiment in that the second embodiment includes locking mechanisms 70.

The locking mechanism 70 includes a locking portion 71 formed on the cover 3 and a locked portion 72 formed on the packing 4. The locking portion 71 is formed on the main wall portion 35 of the cover 3. More specifically, the locking portion 71 is arranged at each of four sides of the mating portion 37. For example, the locking portion 71 is positioned adjacently to a center portion of each side of the mating portion 37. The locking portion 71 is formed, for example, by cutting out a U-shaped notch from the main wall portion 35. The locking portion 71 is a piece portion projecting toward a direction separating from the mating portion 37.

As illustrated in FIG. 18, the packing 4 has locked portions 72. The locked portion 72 projects from the side surface of the body 41. The locked portion 72 is arranged at each of four sides of the body 41. For example, the locked portion 72 is positioned at a center portion of each side of the body 41. The locked portion 72 is a plate-like projection projecting toward the axial direction AX. The locked portion 72 has a locked hole 72*a*. The locked hole 72*a* penetrates the locked portion 72 in the direction of thickness of the plate.

The packing 4 is mounted on the cover 3 with the locking portions 71 of the cover 3 arranged in the locked portions 72 of the packing 4. The locking portion 71 locks the packing 4 at least in the axial direction AX. This configuration can further effectively prevent displacement of the packing 4 to the cover 3 and unintentional detachment of the packing 4. The locking portion 71 may be configured to prevent uplift of the body 41 from the cover 3. For example, the locking portion 71 may be T-shaped with its front end extended. The extended front end locks the locked portion 72, thereby preventing uplift of the body 41.

Third Embodiment

Figure 19:
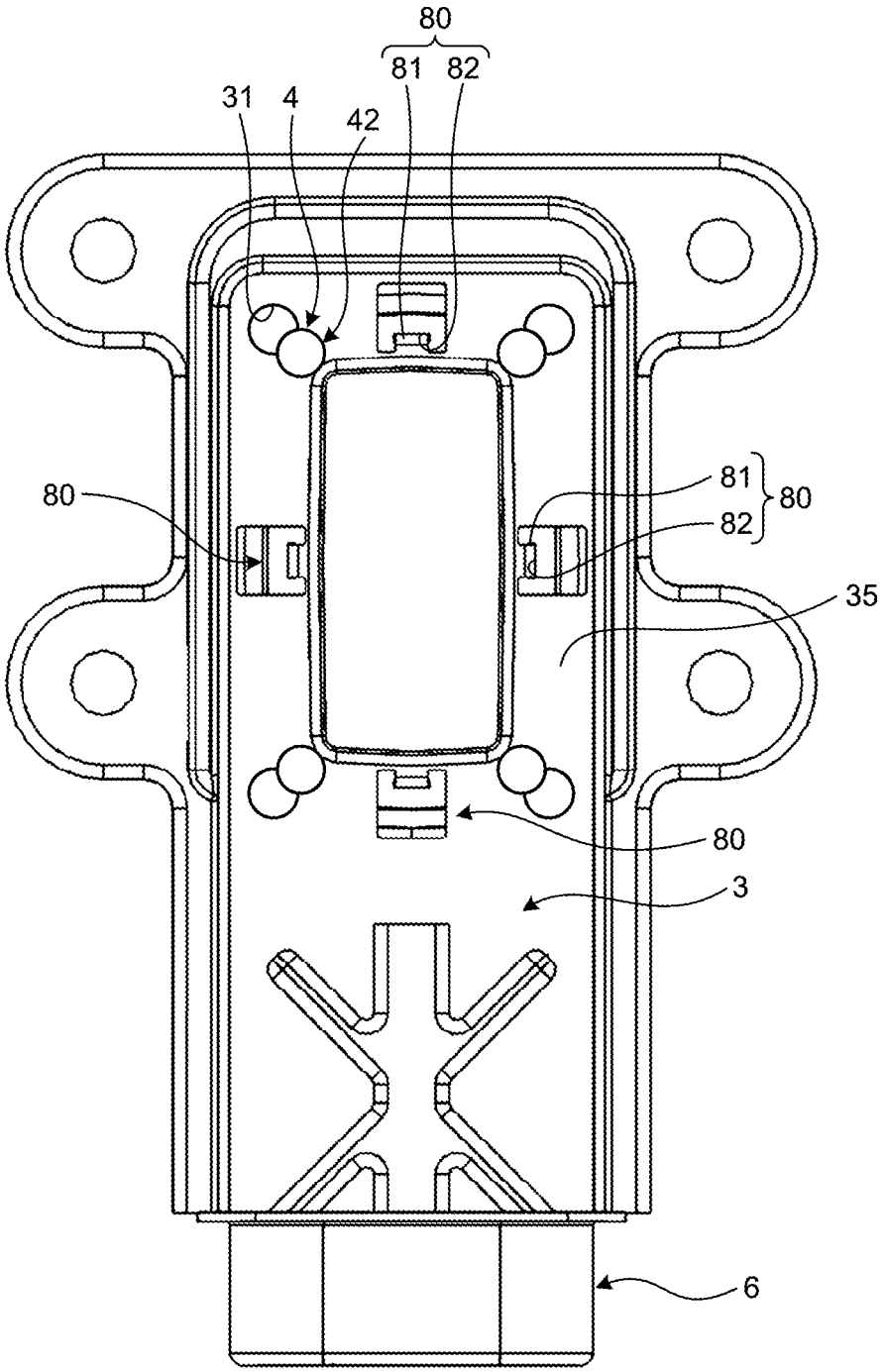
FIG. 19 is a plan view of a connector according to a third embodiment.
Figure 20:
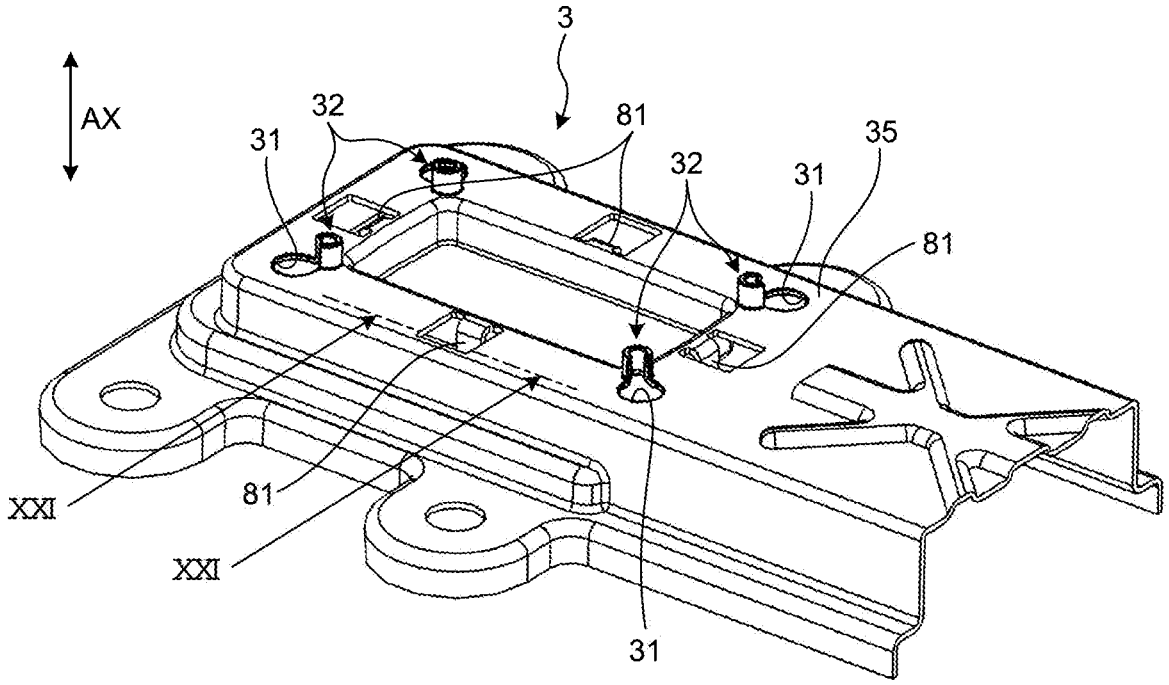
FIG. 20 is a perspective view of a cover according to the third embodiment.
Figure 21:
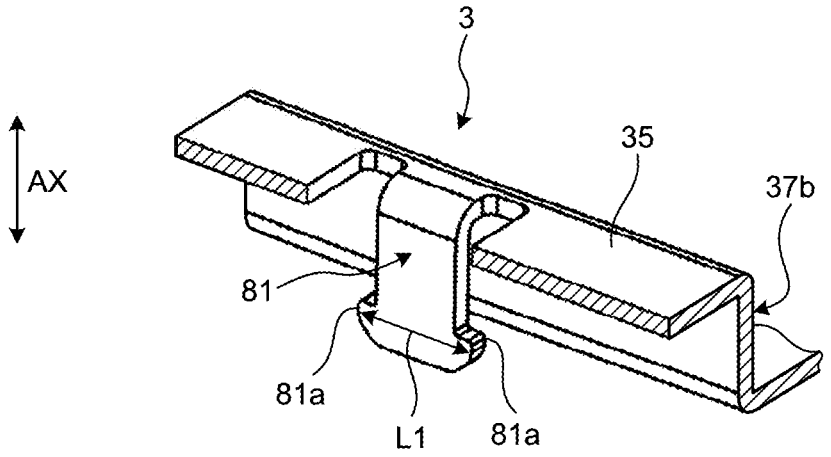
FIG. 21 is an enlarged perspective view of a locking portion according to the third embodiment.
Figure 22:
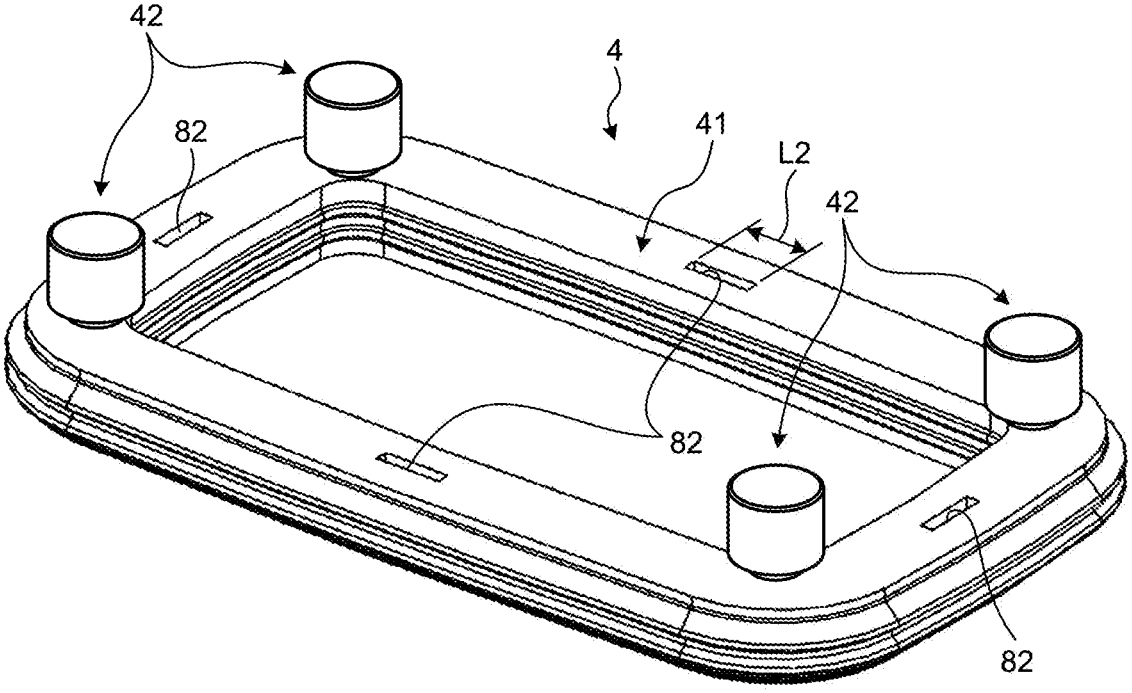
FIG. 22 is a perspective view of a packing according to the third embodiment.

A third embodiment will now be described with reference to FIGS. 19 to 22. In the third embodiment, components having the same functions as those described in the first and the second embodiments will be indicated by the same numerals, and repeated description will be omitted. FIG. 19 is a plan view of a connector according to the third embodiment. FIG. 20 is a perspective view of a cover according to the third embodiment. FIG. 21 is an enlarged perspective view of a locking portion according to the third embodiment. FIG. 22 is a perspective view of a packing according to the third embodiment. FIG. 21 is a sectional view of FIG. 20 along XXI-XXI line. The waterproof structure 10 for a connector according to the third embodiment is different from the waterproof structure 10 for a connector according to the above-described first embodiment in that the third embodiment includes locking mechanisms 80.

The locking mechanism 80 includes a locking portion 81 formed on the cover 3 and a locked portion 82 formed on the packing 4. The locking portion 81 is formed on the main wall portion 35 of the cover 3. More specifically, the locking portion 81 is arranged at each of four sides of the mating portion 37. The locking portion 81 is formed by, for example, cutting and bending work on the main wall portion 35. The locking portion 81 is formed by bending a piece portion formed on the main wall portion 35 to the interior space side of the cover 3.

As illustrated in FIG. 20 and FIG. 21, the main wall portion 35 of the cover 3 has the locking portions 81 formed by cutting work and others. For example, a T-shaped locking portion 81 is formed by cutting the peripheral portions. The locking portion 81 is a plate-like piece portion bending in the axial direction AX at its base end. The locking portion 81 has a pair of locking claws 81*a* projecting toward respective lateral sides, at its front end.

As illustrated in FIG. 22, the packing 4 has the locked portions 82. The locked portion 82 is a hole portion formed on the body 41 of the packing 4. The locked portion 82 penetrates the body 41 from a side surface to the other side surface. The locked portion 82 is an elongated rectangle. A length L2 of the locked portion 82 is smaller than a largest width L1 (see FIG. 21) of the locking portion 81.

The packing 4 is mounted on the cover 3 with the locking portions 81 of the cover 3 arranged in the locked portions 82 of the packing 4. The locking claws 81*a* of the locking portion 81 is inserted into the locked portion 82 while spreading the locked portion 82. The locking portion 81 is inserted into the locked portion 82 at least to a depth at which the locking claws 81*a* pass through the locked portion 82. The locked portion 82 is positioned such that the packing 4 closely contacts the peripheral wall portion 37*b* of the cover 3. In other words, the position of the locked portion 82 is determined so that the body 41 can enter the clearance between the locking portion 81 and the peripheral wall portion 37*b* while being compressed when the locking portion 81 is inserted into the locked portion 82.

The locking portion 81 arranged in the locked portion 82 locks the packing 4 at least in the axial direction AX. This configuration can further effectively prevent displacement of the packing 4 to the cover 3 and unintentional detachment of the packing 4. The locking portion 81 further prevents uplift of the body 41 from the peripheral wall portion 37*b* of the cover 3.

Modification A modification of the first to the third embodiments will now be described. The cross sections of the tubular portion 25 and the mating portion 37 are not necessarily rectangular. For example, the cross sections of the tubular portion 25 and the mating portion 37 may be polygonal other than rectangular, or circular including elliptical. The shape of the body 41 of the packing 4 is determined in a manner fitting to the cross sections of the tubular portion 25 and the mating portion 37.

In the embodiments, the locking mechanism constituted by the projection 32 and the locked portion 46 is arranged at each of four corners of the mating portion 37. The locking mechanism may be additionally arranged at another location. For example, the through hole 31, the projection 32, and the locked portion 46 may be arranged along a long side of the mating portion 37. As an example, the through hole 31, the projection 32, and the locked portion 46 may be arranged at a center portion of a long side of the mating portion 37.

The packing 4 may be mounted on the side wall portion 36 instead of on the mating portion 37. In this case, the projection 32 may be formed closely to the side wall portion 36 with respect to the through hole 31.

The tubular portion 46*a* of the locked portion 46 may be tapered in a manner to become thinner toward its opening. This shape can widen the entrance side and easily let in a counterpart portion.

The waterproof structure 10 for a connector according to the embodiments are applicable to connectors other than a shield connector. The waterproof structure 10 for a connector is applicable to various types of connector.

The content described in the embodiments and the modification can be implemented in combination as appropriate.

A waterproof structure for a connector according to the present embodiment includes a housing retaining terminals and having an opening, a cover closing the opening, and a packing mounted on the cover and sealing between the housing and the cover at the opening. The cover has through holes and projections projecting from an outer surface of the cover. The packing has a body sandwiched between the housing and the cover and locked portions continuous to the body. The locked portion projects to an exterior space of the cover from the through hole toward a direction in which the projection projects, and the locked portion is locked by the projection at least in a direction perpendicular to the direction of projection of the projection. In the waterproof structure for a connector according to the present embodiment, the locked portion projects to an exterior space of the cover from the through hole toward the direction of projection of the projection and is locked in a direction perpendicular to the direction of projection of the projection. This configuration restricts move of the locked portion toward the front end of the projection, and prevents the locked portion from slipping out of the projection. This configuration is therefore advantageous in preventing unintentional detachment of the packing.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector having a waterproof structure comprising:

a housing that retains a terminal and has an opening;

a cover that closes the opening; and a packing that is mounted on the cover and seals between the housing and the cover around the opening, wherein the cover has a through hole and a projection projecting from an outer surface of the cover, the packing has a body sandwiched between the housing and the cover and a retaining unit including a shaft portion connected between a locked portion and the body, and the locked portion projects to an exterior space of the cover from the through hole toward a direction in which the projection projects, and the locked portion is locked by the projection at least in a direction perpendicular to the direction in which the projection projects and restricts movement of the retaining unit in a detachment direction.

2. The waterproof structure for a connector according to claim 1, wherein the projection projects from the outer surface of the cover toward a side opposite to a side of the housing, the locked portion is capable of receiving the projection, and the projection locks the locked portion by being arranged in the locked portion.

3. The waterproof structure for a connector according to claim 1, wherein the locked portion is further locked by a front end of the projection in the direction in which the projection projects.

4. The waterproof structure for a connector according to claim 2, wherein the locked portion is further locked by a front end of the projection in the direction in which the projection projects.

5. The waterproof structure for a connector according to claim 3, wherein the projection projects from an edge of the through hole and has an arcuate cross section that is open toward a side of the through hole, the locked portion has a recessed portion that receives a front end portion of the projection, and the locked portion is locked by the projection arranged in the recessed portion.

6. The waterproof structure for a connector according to claim 4, wherein the projection projects from an edge of the through hole and has an arcuate cross section that is open toward a side of the through hole, the packing has a shaft portion connecting between the body and the locked portion, and the locked portion has a recessed portion that receives a front end portion of the projection, and the locked portion is locked by the projection arranged in the recessed portion.

* * * * *